US006279306B1

(12) United States Patent
Langen

(10) Patent No.: US 6,279,306 B1
(45) Date of Patent: Aug. 28, 2001

(54) OPERATOR CONTROLLED SPINNING CAN TRANSPORTER

(76) Inventor: Manfred Langen, Flughafenstrasse 61, D-41066 Mönchengladbach (DE)

( * ) Notice: Subject to any disclaimer, the term of this patent is extended or adjusted under 35 U.S.C. 154(b) by 0 days.

(21) Appl. No.: 09/637,073

(22) Filed: Aug. 11, 2000

(30) Foreign Application Priority Data

Nov. 5, 1999 (DE) ..... 199 53 202

(51) Int. Cl.[7] ..... D01H 9/18

(52) U.S. Cl. ..... 57/281; 19/159 A; 57/90; 242/533.8; 414/426

(58) Field of Search ..... 19/159 A, 65 A; 57/90, 281; 242/533.8; 414/426

(56) References Cited

U.S. PATENT DOCUMENTS 3,871,087 * 3/1975 Savageau et al. ..... 19/159 A
4,194,866 * 3/1980 Fritschi et al. ..... 414/559
5,797,557 * 8/1998 Wang et al. ..... 414/331

FOREIGN PATENT DOCUMENTS 44 28 247 2/1996 (DE) .
197 21 640 10/1998 (DE) .
197 19 765 11/1998 (DE) .

* cited by examiner

*Primary Examiner*—Andy Falik
(74) *Attorney, Agent, or Firm*—Collard & Roe, P.C.

(57) ABSTRACT

A spinning can transporter for a plurality of spinning cans disposed on a platform. The platform has a standing place for the operator or driver equipped with controls for steering the transporter. To make it possible for the operator/driver to exchange spinning cans from the operator's standing place, these controls are always within reach of the operator. This results because the controls are adjustably mounted on the transporter loading platform. In addition, there is at least one can loading area in front of, and at least one can loading area behind the operator's standing place to allow the operator to move relative to the cans to alternatively dispose of or receive cans onto the platform.

18 Claims, 5 Drawing Sheets

OPERATOR CONTROLLED SPINNING CAN TRANSPORTER

BACKGROUND OF THE INVENTION

1. Field of the Invention

The invention relates to a spinning can transporter comprising a plurality of spaces for setting up a series of spinning cans on a platform. The platform is for loading or unloading the cans. These spinning cans can be full, or empty, round, or rectangular and are usually set up in a series of loading spaces in a standing position. Furthermore, the transporter comprises a standing place for the operator/driver. From this position, the driver can reach the controls for controlling this transporter.

These spinning cans are used to transport strands of fiber material that are also referred to as roving. The cans are transported to and from drawers or drawing frames, as well as flyers and spinning machines. After each can has been filled or run empty, the can has to be replaced by a new empty or, respectively, full can.

Normally, the roving is conventionally transported in so-called round cans. These round cans have a cylindrical shape and are formed in standardized sizes. However, with modern spinning machines, the roving is supplied to the machine in rectangular cans. These cans also have standardized sizes, having the shape of a square building stone. These rectangular cans are positioned in the spinning positions or on the spindles of a spinning machine with the wide sides of the rectangle facing each other.

The spinning can transporters are used to transport the spinning cans to and from the machine. At each interval, this transporter delivers to, or picks up from the spinning machine only a particular number of full or, respectively, empty cans. The transporter is limited because it must always leave an open can space on the loading platform of the transporter. This is necessary on a spinning machine because when replacing cans the transporter first has to pick up an empty can to make room for a full can for deposit in a take off position of the spinning machine. In the course of its operation, the can transporter travels in a driving lane along the machine it has to serve, for example between two rows of spinning cans. Measured transversely to the driving lane, the transporter has to be as narrow as possible and not substantially wider than the length of a rectangular can. Driven transporters of the type specified above can be freely maneuvered and inductively guided on these rails. These transporters may have their own drives or they may be towed by external means.

Spinning can transporters primarily transport full spinning cans from the drawer or drawing frame to the flyer or spinning machine, and return with empty spinning cans in the reverse or opposite direction. The cans can be pulled up to the transporter onto platforms, or pushed onto these platforms on roller or sliding guides, and removed from the transporter in the same way.

With conventional transporters, a stand, having a control panel for the operator or driver, is located at one of the longitudinal ends of the transporter vehicle. For this reason, the operator normally has to step from the operator's stand for replacing empty cans with full cans, or vice versa. Since the controls for driving and steering the vehicle are located at the operator's stand, the operator has to return to the operator's stand after completing the exchange of cans.

2. The Prior Art

This operating method is complicated and time-consuming. The distance the operator has to walk per shift amounts to about 14 kilometers. Since large numbers of spinning cans have to be exchanged, for example 80 to 500 cans per hour, in open-end spinning installations, a handling device of the type described in DE 197 21 640 A1has already been developed for spinning can transporters. This device makes it possible to exchange the cans mechanically from the operator's stand with the help of gripping devices mounted on the transporter itself. However, this "remotely controlled" can exchange takes more time than the manipulation of the cans by hand. Furthermore, the mechanical manipulator needed on each transporter is costly.

The invention is designed to provide a spinning can transporter that makes it possible for the operator to exchange the cans manually with the help of controls that are always within his reach and without having to step from or leave the operator's stand.

SUMMARY OF THE INVENTION

The transporter comprises a stand for the operator, with controls for driving and steering the transporter disposed along the stand so that they are directly reachable by hand. In this case, the transporter as viewed in its longitudinal direction, contains at least one can set-up or loading platform for cans on either side, such as in front of, and behind the standing place for the operator. In essence, this means that the standing place for the operator is located between the loading areas for picking up the cans and the spaces for depositing the cans.

This invention is designed so that the operator's position on the transporter is always so closely located to the can placement site to be served that the operator is able to reach this site or space with his hands without having to leave his position on the transporter. There are basically two main embodiments of the invention with respect to the standing place for the operator or driver. In the first embodiment, the transporter provides a standing place for the operator to migrate. In this case, the controls migrate as well in the longitudinal direction of the transporter during loading and unloading of cans. This is so the operator's standing place migrates on the loading platform of the transporter as cans are being exchanged.

In the second embodiment, the operator's standing place, including the controls, is installed fixed between two partial loading areas of the loading platform. In this case, the operator's standing place is preferably located in the center of the transporter between two equally sized front and back loading areas.

In the first embodiment, the loading platform can serve as the standing place for the operator at any point along the platform. To stand, the operator needs two places for rectangular cans or one place for round cans. Therefore, with the first variation of the invention, these places have to be kept variably free on the loading platform for the operator. As stated above, to carry out an exchange of cans on a machine that processes roving, such as a spinning machine or a flyer, there is required another piece for a can in addition to the standing place for the operator. This space for another can is unoccupied at first, and offers space for a can that has run empty on a spinning machine. According to another feature of the invention, this empty space directly borders on the migrating or standing place for the operator. When necessary, the operator can pull up an empty can into the free transporter space with optimal ease without leaving his position on the loading platform because the can space to be filled (or occupied), or to be vacated, directly borders on the standing place of the operator.

In another feature of the invention, the loading platform is designed so that there is at least one space for receiving a can on the one side of the standing place for the operator, and there is at least one space for unloading a can on the other side of said standing place. Under this precondition, the transporter can be loaded on a line with many full cans adjacent to each other so that there is only the standing place for the driver and one place for an empty can at a longitudinal end of the loading area. Therefore, to transport rectangular cans, two can loading spaces are required for the operator and one can loading space for pulling up an empty can. This latter place is hereinafter a "can receiving space," whereas the places occupied by the full cans are hereinafter "can delivering spaces."

During the processing of roving, with a spinning machine, the cans normally become empty individually and consequently have to be replaced by full cans individually as well. Here, the driver/operator maneuvers his transporter, while there are still full cans on the transporter. These full cans are close to an empty can on the spinning machine so that he can pull the empty can by hand into the empty-can receiving place located next to him. Then the operator drives the transporter on and maneuvers it so that the full can located closest to him on the loading platform is placed in front of the empty space on the spinning machine. Next, the driver subsequently pushes the full can standing directly next to him into the space on the spinning machine that has become empty.

If only full cans or spaces for full cans are located on the one side of the operator, and only empty cans or spaces for empty cans on the other side of the operator, the standing place of the operator migrates by one can space along the transporter after each exchange of cans until the last full can has been finally pushed off and only one (empty) can delivering space remains available on one side of the operator. In this case, there are only full can receiving spaces occupied by empty cans on the other side of the operator.

The transporter loaded on the spinning machine with empty cans can drive to a machine supplying the roving, such as to a drawing frame, and replace the empty cans with full cans. The procedure for exchanging these cans involves first, loading all empty cans on the transporter, and simultaneously pushing these empty cans from the transporter. Next, the transporter is then filled with an equal number of full cans. The full cans can be pushed onto the transporter as the empty cans are being pushed off. The vehicle, now loaded with full cans, then carries a group of full cans loaded successively in the longitudinal direction of the transporter and standing closely next to one another in can delivery spaces. The transporter here has one or two empty can spaces as a standing place for the operator and one empty space for receiving a can.

An important benefit of the first embodiment of the invention is that the controls for driving and steering the transporter, migrate together with the standing place of the driver in the longitudinal direction of the transporter as cans are being loaded and unloaded. Therefore, irrespective of where the standing place for the operator is located at a given moment, the operator is both optimally close to the site where a can is replaced, and close to the controls so that they are within his reach.

Another feature of the invention, is that the controls are displaceably supported and particularly displaceably suspended, moving above and across the cans in the longitudinal direction of the transporter. There is also a guide means that is secured overhead the operator on the transporter as the means for supporting the controls. From this overhead guide, the controls are displaceable in the longitudinal direction of the transporter and hang down to the level where they can be reached and gripped by the hands of the operator, so that the operator/driver can comfortably select and set by hand whichever functions are desired. The vertical adjustability of the controls are adapted to the body size of the operator, so that the control can be displaced above and across the cans.

The above explanations primarily concern the exchange of rectangular cans. These cans have a width that is approximately 230 mm that is measured transverse to the longitudinal direction of the transporter. If, however, the can transporter is used for exchanging round cans having a cylinder diameter of, 460 mm, one single set-up space for loading round cans on the loading platform suffices as the standing place for the operator. Thus, a can transporter loaded on the drawing frame with full round cans can carry a plurality of round cans positioned adjacent to each other in the longitudinal direction of the transporter. However, two loading spaces for round cans are left free at one longitudinal end of the loading platform, wherein the one empty can space that borders on the full round cans, serves as the standing place for the operator. In addition, the other empty can space is the vacant space for receiving the empty can. In this case, the vacant space is filled on the spinning machine with the first empty can. In all other respects, the operation and structure are substantially the same as with the exchange of rectangular cans.

In the second embodiment of the invention, the transporter comprises both a loading platform and a standing place for the operator. In this case, the loading platform comprises two part loading areas, specifically a front loading area and a rear loading area located in front of and, respectively, behind the standing place for the operator. Here, these two areas are equally sized. Therefore, the standing place for the operator is shifted to a center region of the loading platform to make it possible for the operator to carry out the replacement of cans from his standing place. In this way, the platform is permanently divided in a fixed manner in two equally sized front and rear loading areas. In addition, there should be maximum spacing between the standing place for the operator and the can set-up or loading spaces on the transporter. Here, this spacing can be preset by the operator while he remains in the operator's standing place for carrying out a can exchange manually. With the second alternative, therefore, the site where cans are exchanged is not always located directly next to the position of the operator, so that the number of can spaces is limited, as opposed to the first embodiment of the invention.

The second embodiment is designed so that the can loading spaces are located in the front and rear loading areas and can be reached and served by the operator by hand, enabling him to carry out the can exchanges manually. The transporter is designed so that the operator can manually load the transporter from his standing place, based upon the dimensions of each of the two part loading areas. The operator only has to face the respective part loading area and would only have to bend forward slightly.

The spinning can transporter of the second embodiment contains improvements for the exchange of rectangular cans. Three rectangular cans standing flatly against one another span a distance of about 70 cm. The operator can reach over this a distance from the operator's standing place without problems. Therefore, each part loading area for receiving rectangular cans comprises spaces for three rectangular cans. A spinning can transporter for rectangular spinning cans consequently must have three spaces each in front of, and behind the operator's standing place for rectangular cans. In this case, the rectangular cans must stand flatly against each other with the largest surface of their cross-section. Although three spaces for rectangular cans are preferred in each part loading area within the framework of the invention, two or four spaces can also be considered.

The spinning can transporter of the second embodiment is suitable for exchanging round cans as well. Three of these round cans each have a diameter of about 460 mm. These three cans standing in a row in the direction of transport, could hardly be spanned by the operator from the operator's standing place. With the second embodiment of the invention, the transporter is designed so that each part loading area that receives round cans has a revolving table that comprises at least two, but preferably three or four spaces for setting up round cans. Since the round cans are much lighter in weight than rectangular cans, the revolving table can be designed for manual turning about its axis of rotation. The revolving table consequently does not substantially increase the expense to produce and operate the spinning can transporter. However, it is possible to provide a mechanical or motor drive for the revolving table.

This revolving table of the round-can transporter has to be first turned to exchange cans so that an empty can space on the transporter is facing a can on a spinning machine that has run empty. The empty can is then pulled from this empty space from the standing place of the operator. The revolving table is subsequently turned until a full can is located in front of the space on the spinning machine that has become empty, and the full can is then pushed into this empty space. As with the first embodiment, the site where a can is exchanged is thus always optimally close to the position of the operator/driver. Furthermore, the revolving table offers the additional advantage in that the transporter can stop when a can is exchanged, so that an empty can is replaced by a full can. The can exchange on a drawing frame basically takes place in the same way, but in the reversed sequence.

The second embodiment of the invention provides many variations for round or rectangular cans. For example, a transporter actually designed for round cans can also be used to exchange rectangular cans. In addition, a revolving table that was originally used for round cans can instead be used for positioning three rectangular cans arranged non-rotatably adjacent to each other in the longitudinal direction of the transporter. In addition, the individual spinning can transporter can be designed to exchange a rectangular can in its one part loading area, and to exchange a round can in its other part loading area.

The invention also includes rollers or other means for facilitating the displacement of cans along the longitudinal edge of the can transporter, or across its entire loading surface. These rollers are designed to make it easier for the operator to exchange cans by hand while standing in the operator's place. Thus, the amount of force required to push the individual cans onto or from the transporter is reduced to a minimum. The parts of the loading platform that are to be suitable at the same time as a standing place for the operator must offer a safe standing location for the operator.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1C:
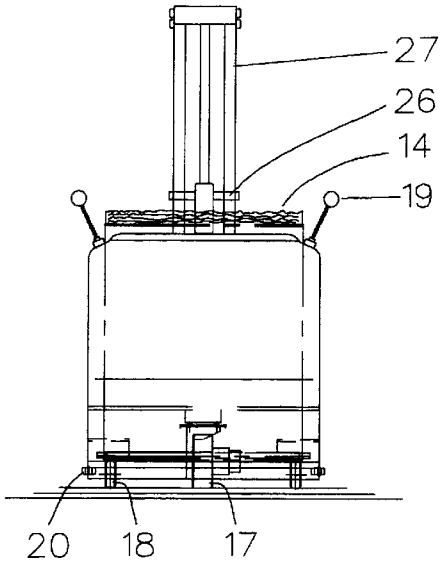
FIG. 1C shows a cross-sectional view of a rectangular-can transporter fully loaded with full cans.
Figure 1A:
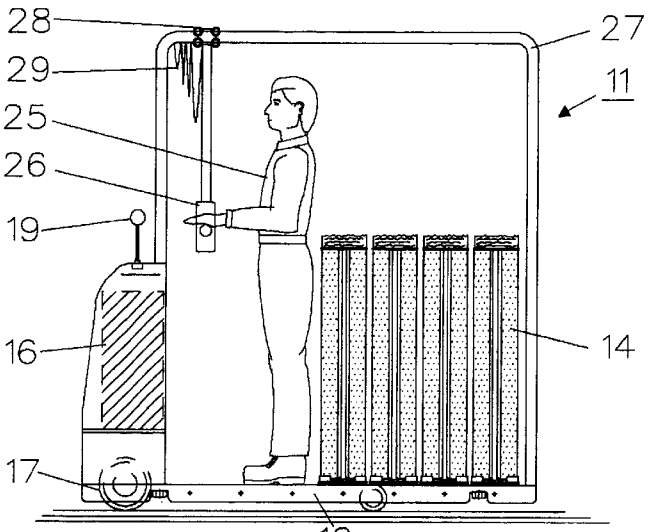
FIG. 1A shows a longitudinal section, of a rectangular-can transporter fully loaded with full cans.
Figure 1B:
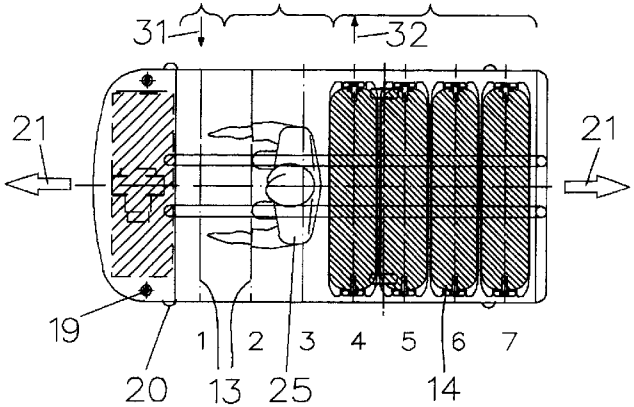
FIG. 1B shows a top view of a rectangular-can transporter fully loaded with full cans.

Referring in detail to the drawings, FIG. 1A, FIG. 1B and FIG. 1C show the first embodiment of the invention, which is a rectangular-can transporter with a migrating standing place for an operator. Spinning can transporter 11 has a loading platform 12, wherein as shown in FIG. 1A and FIG. 1B there are seven can set-up spaces 13, in lanes No.1 to No.7 for one full can 14 in each lane, or for one empty can 15 in each lane (FIG. 2B).

Transporter 11 is equipped with a drive 16 mounted at one of its longitudinal ends. There is least one driving wheel 17 associated with drive 16. Alternatively, transporter 11 can be driven by an external drive with the help of a chain drive installed in the floor (not shown). Furthermore, transporter 11 can contain steering and supporting wheels 18 (FIG. 1C). Moreover, transporter 11 contains safety sensors or switches or flashing lights 19 located in various sites on transporter 11. Also, a series of lateral guide rollers 20 are useful especially if the transporter can be freely maneuvered. To steer the transporter automatically, guide rollers 20 are replaced by a guiding line or by an inductive guiding system.

In the first embodiment of the invention, transporter 11 is designed to provide an operator standing place 22 which migrates in a longitudinal direction 21 of transporter 11 when loading and unloading cans. As viewed in longitudinal direction 21 of the transporter in FIG. 1A and FIG. 1B, an empty can receiving space 23 known as lane No. 1 is located on one left side of operator's standing place 22. Standing place 22 is momentarily positioned in lane Nos. 2 and 3, whereas four can delivery spaces 24, which are loaded with full cans 14, are shown located in the lanes Nos. 4 to 7 on the right side of the operator's standing place 22. In FIGS. 1A to 3B, each of the can receiving and can delivery spaces 23 and 24 comprises a place 13 for loading or setting up a rectangular can. However, two rectangular can set-up places 13 are needed as the standing place 22 for the operator/driver 25.

According to the invention, operator's standing place 22 including controls 26 associated therewith, migrate during loading and unloading in the longitudinal direction 21 of the transporter, so that controls 26 are always within the reach of operator 25 without requiring the operator 25 to leave his standing place 23 on loading platform 12. In the first embodiment shown, the controls are secured on bow 27 extending at the overhead level in longitudinal direction 21 of transporter 11 and mounted so that these controls can be shifted back and forth on bow 27 in the longitudinal direction 21 with the help of carriage 28. Associated control cable 29 can also be suspended on the bow in loops as shown, wherein the cable transmits the control demands for driving and steering from controls 26 to drive 16.

FIG. 1A and FIG. 1B show the loading condition in which transporter 11 has arrived on a can that has run empty on a spinning machine. This transporter comes from a drawing frame. The respective empty can is transferred to can receiving space 23 shown in FIG. 2B in the direction of arrow 31 shown in FIG. 1B. By picking up empty can 15, a space has become available on the spinning machine and full can 14 has to be pushed into this empty space from can space 13 in lane No. 4 in the direction of the arrow 32. This can space 13 directly borders on the position of operator 25. The result is shown in FIGS. 2A and 2B.

Figure 2A:
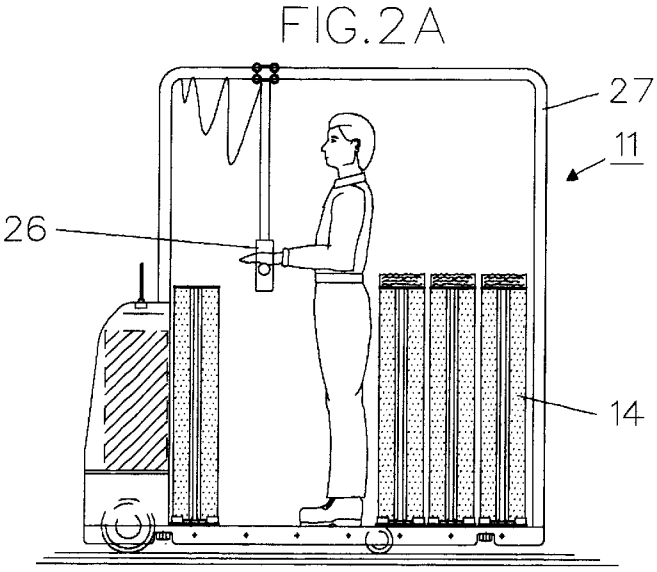
FIG. 2A shows a top view of a rectangular-can transporter according to FIG. 1A, on which a full can has already been replaced by an empty can.
Figure 2B:
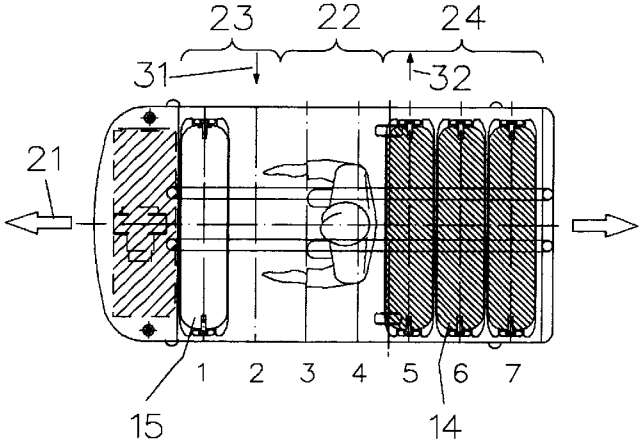
FIG. 2B shows a top view of a rectangular-can transporter on which a full can has been replaced by an empty can.

The comparison between FIG. 1A and FIG. 2B and FIG. 2A and FIG. 2B show that the first exchange of cans has caused the operator's standing place 22 to shift by one can thickness to the right in longitudinal direction 21 of the transporter. According to FIG. 2A and FIG. 2B, operator's standing place 22 is no longer located between lane Nos. 1 and 4 but is now situated between lane Nos. 2 and 5. In the course of further can exchanges, operator's standing place 22 migrates in the direction of higher lane numbers until it has finally arrived in lane Nos. 5 and 6. In addition, lane No. 7 has now also become available because the full can 14 originally located there has been replaced by the empty can 15 placed in lane No. 4. Therefore, at the end of this procedure, operator's standing place 22 is located in the lane Nos. 5 and 6, whereas can receiving place 23 occupied by empty cans 15 is designed to the left of operator 25 in lane Nos. 1 and 4, and to the right of empty can delivery space 23 in lane No. 7.

Figure 3A:
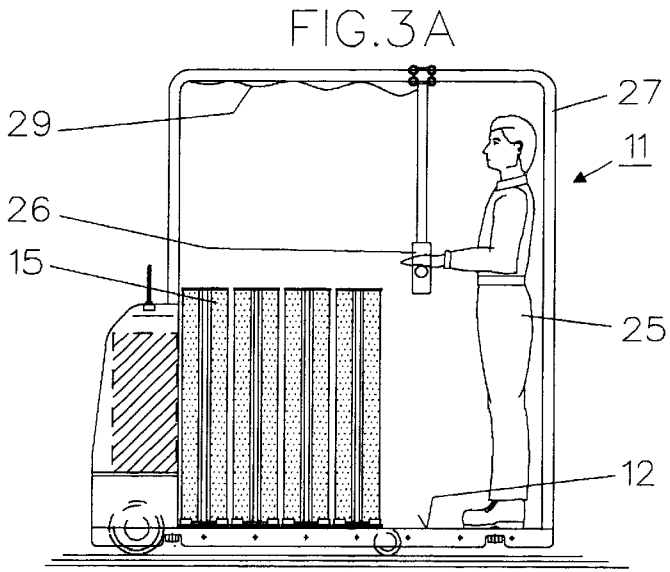
FIG. 3A shows a longitudinal section of a rectangular-can transporter according to FIG. 1A, where all full cans have been replaced by empty cans.
Figure 3B:
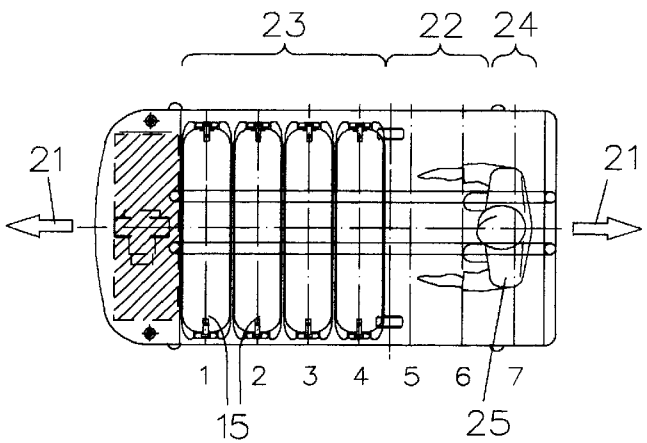
FIG. 3B shows a top view of a rectangular-can transporter according to FIG. 1B, where all full cans have been replaced by empty cans.
Figures 4A, 4B:
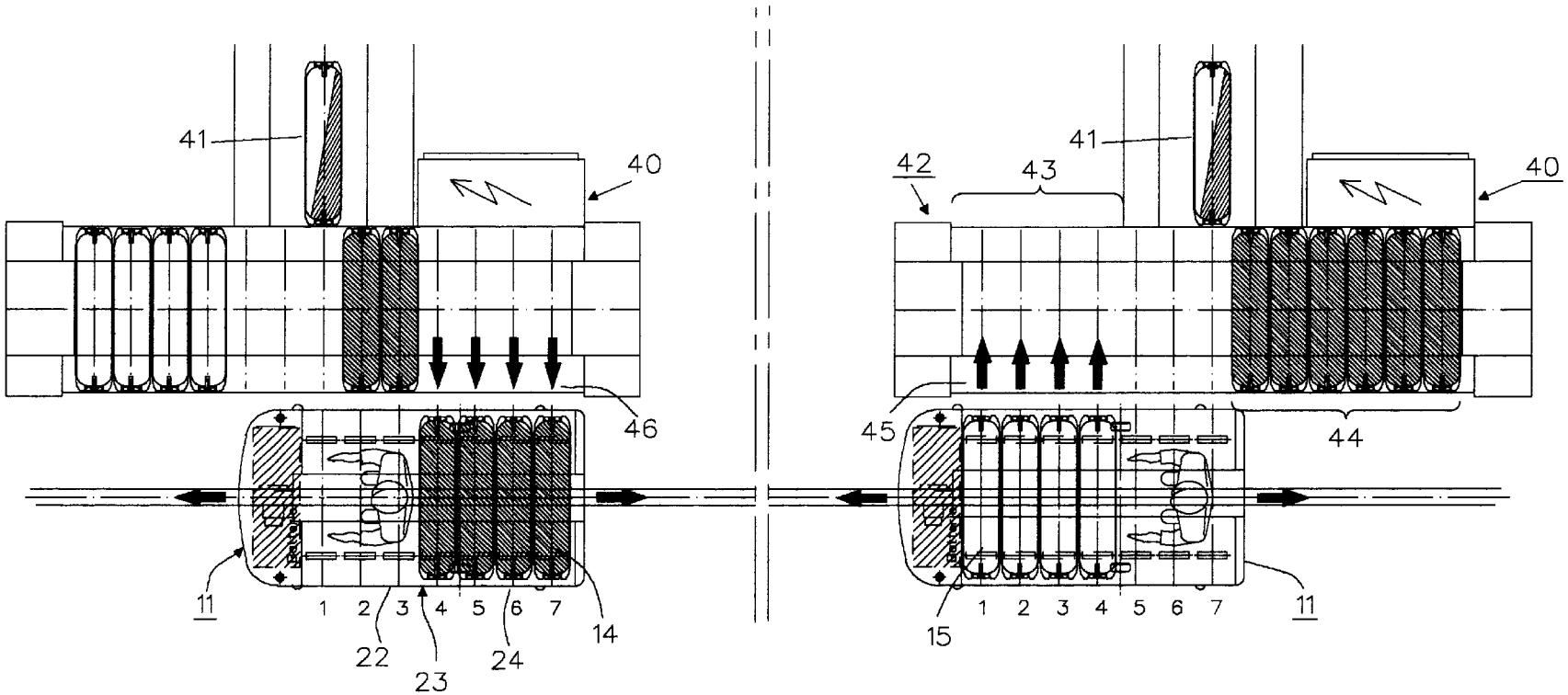
FIG. 4A shows the exchange of cans on a drawing frame wherein a=unloading of the empty cans; b=loading of the full cans.
FIG. 4B shows the exchange of cans on a drawing frame.

In the loading condition according to FIG. 3A and FIG. 3B, transporter 11 can drive to a drawing frame shown in FIG. 4A. This drawing frame as a whole is denoted in FIG. 4A and FIG. 4B by reference numeral 40. This embodiment comprises can filling stations 41 of drawing frame 40 and drawing frame storage 42. Drawing frame storage 42 comprises empty-can area 43 and full-can area 44. After a can has been completely filled in filling position 41, it is pushed into full-can area 44. As a replacement, an empty can is transferred from empty-can area 43 to filling position 41.

After transporter 11 has arrived at drawing frame 40 with four empty cans 15 according to FIG. 4A, these four empty cans 15 can be simultaneously moved into empty-can area 43 in feeding direction 45 shown by the arrows. This procedure empties transporter 11 completely and it can now drive on as shown in FIG. 4B and pick up four full cans 14 from full-can area 44 of drawing frame storage 42. Full cans 14 can be simultaneously pushed onto transporter 11 as well, in feeding direction 46. FIG. 4B shows the positioning of can receiving place 23, operator's standing place 22 and filled can delivery place 24.

According to FIGS. 1A to 3B, controls 26 are designed as a dead-man control system. This means that the individual functions can be set and adjusted only if operator 25 holds controls 26 simultaneously with both hands.

Figure 5C:
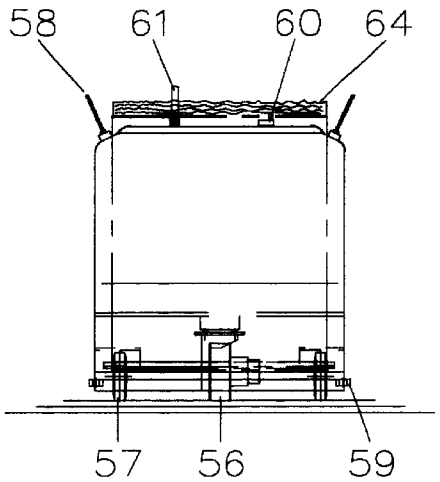
FIG. 5C shows a cross-sectional view of the rectangular-can transporter shown in FIG. 5A.
Figure 5A:
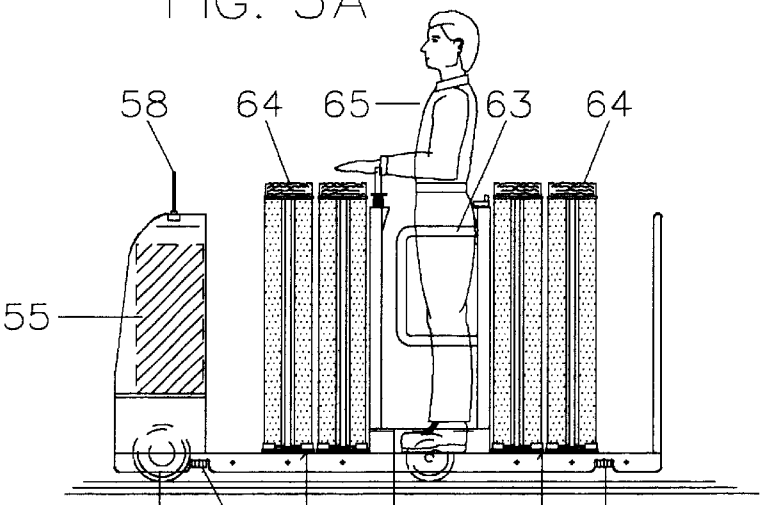
FIG. 5A shows a longitudinal section of a rectangular-can transporter with a standing place for the operator located fixed in the center of the loading area.

FIGS. 5A to 7B show a second embodiment of the spinning can transporter with an operator's standing place located fixed in the center of the loading platform. FIG. 1C shows the cross section that is similar to the one in FIGS. 5A to 7B. Transporter 51 comprises front loading area 52, rear loading area 53, and standing place 54 for operator 25. The terms "front" and "rear" are used here for distinguishing purposes and are interchangeable. As shown in FIG. 5A, transporter 51 is equipped with drive 55 mounted at one of longitudinal ends or elsewhere, such as in FIG. 7B in a center region below operator's standing place 54 (not shown). At least one driving wheel 56 is associated with drive 55. Furthermore, similar to FIGS. 1A to 4B, transporter 51 is equipped with steering or swiveling/supporting wheels 57, safety sensors/switches 58, lateral guide rollers 59, and steering mechanism 60 and "autopilot" 61.

Figure 6A:
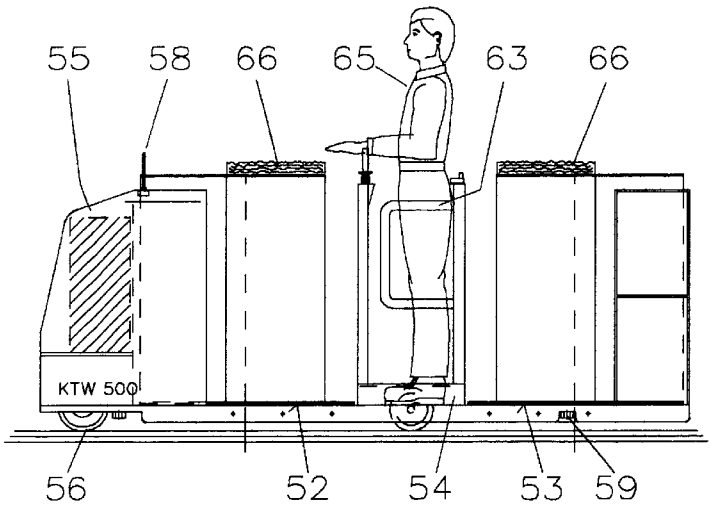
FIG. 6A shows a longitudinal section of a round-can transporter with a fixed standing place for the operator in the center of the loading area and three can set-up spaces each in the front and rear loading areas.
Figure 6B:
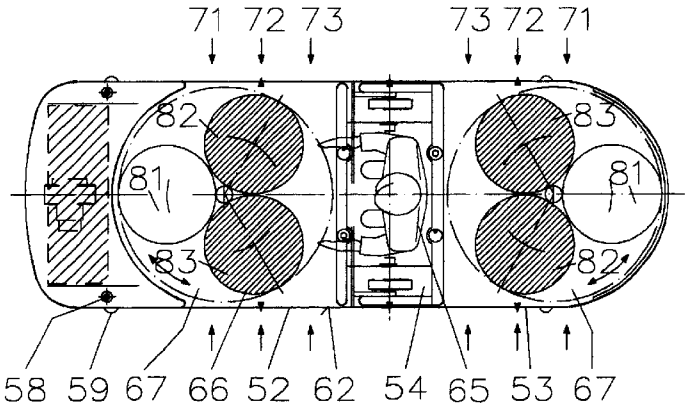
FIG. 6B shows a top view of a round-can transporter according to FIG. 6A.

As shown in FIG. 6A, and FIG. 6B, operator's standing place 54 can be protected at two longitudinal sides 62 of transporter 61 by safety bows 63. The driving, steering, safety and guiding means etc. can be interchanged with the corresponding parts of the transporter according to FIGS. 1A to 3B.

Figure 5B:
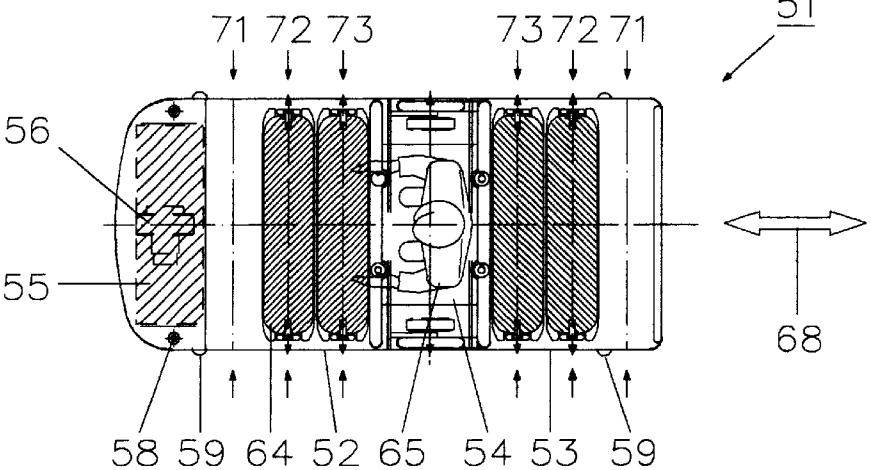
FIG. 5B shows a top view of a rectangular-can transporter as shown in FIG. 5A.

In the exemplified embodiment shown in FIG. 5B, there are three spaces 71, 72 and 73 for rectangular cans 64 in each of the front and rear loading areas 52 and 53, respectively. A set of spaces 71 to 73 permit the positioning of three rectangular cans 64 (FIG. 5B) in each of part loading areas 52, 53. These cans 64 are in standing positions with the large sides of the rectangle flatly abutting one another. Transporter 51 shown in FIG. 5B and FIG. 5C, can be loaded in front and/or rear loading areas 52, 53 with one or two full cans. In this position, transporter 51 can drive up to a spinning machine for a can exchange, and pull a can that has run empty on this machine into vacant can set-up space 71 of transporter 51. Transporter 51 is subsequently driven by one can width, so that a full can, such as can 72 or 73, can be loaded in the space vacated on the spinning machine. This can replacement can be manually controlled by the operator in a standing position from the operator's standing place 54.

FIG. 6A and FIG. 6B show a second embodiment of transporter 51 which is capable of receiving three round cans 66 in each of the front and rear loading areas 52, 53. Round cans 66 are each standing on revolving table 67, which substantially forms the bottom of front and rear loading areas 52 and 53, respectively. At the start of a can exchange on a spinning machine, free loading space 81 shown in the drawing contains a spinning can that has run empty on the spinning machine, so that operator 65 can pull the empty can in a straight line onto available loading space 81 without leaving operator's stand 54. Revolving table 67 is turned so that full can 82 faces a vacated can space on the spinning machine and can be moved into a free space on the spinning machine in a straight line. To create this transfer, operator 65 can remain standing in standing place 54 because he has to drive spinning can transporter 51 close to the row of spinning cans on the spinning machine and move the respective spinning can sideways by only little more than one can diameter.

Figure 7A:
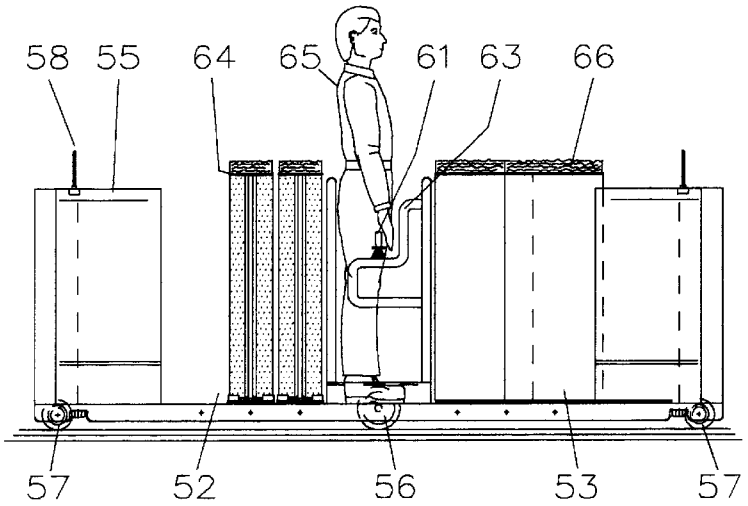
FIG. 7A shows a longitudinal section and top view of a combined rectangular/round can-transporter that has been modified as compared to the transporter shown in FIG. 6A.
Figure 7B:
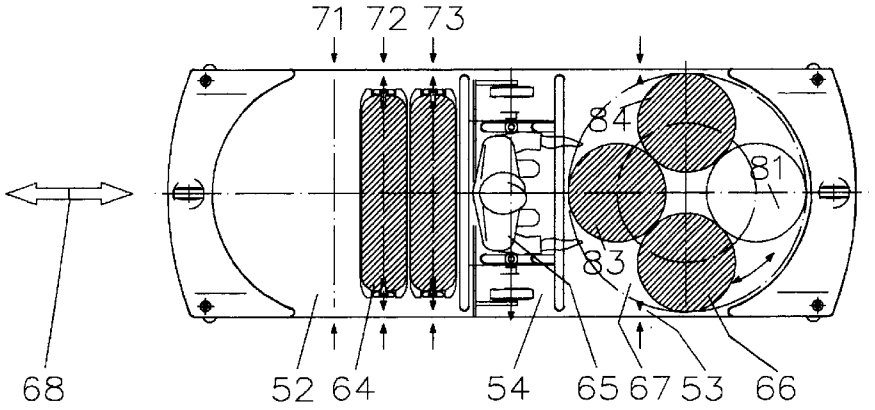
FIG. 7B shows a top view of the can transporter shown in FIG. 7A.

The space occupied by revolving table 67 is designed so that three or four rectangular can spaces are alternatively available as shown in FIG. 5A. This combined spinning can transporter 51 is shown in FIG. 7A and FIG. 7B, which has three rectangular can spaces 71, 72, 73 in front loading area 52, and four loading spaces 81, 82, 83, 84 for four round cans located in rear loading area 53. Of course, in FIG. 7B, it is possible also to create a revolving table with four loading spaces in both the front and rear loading areas. As shown in FIG. 7B, "four-place" revolving table 67 has a slightly larger diameter than the "three-place" revolving table according to FIG. 6B. The entire transporter therefore contains a correspondingly greater width measured transversely to longitudinal direction 68 of the transporter. However, the difference in width is generally only in the order of magnitude of 10% as shown in FIG. 6B. Spinning can transporter 51 can have an overall width of about 1,100 mm, and is in the embodiment shown in FIG. 7B about 1,200 mm. In FIG. 6B and FIG. 7B, revolving tables 67 make it necessary to slightly increase the length of the transporter as compared to FIG. 5A; however, this effect is generally acceptable as well.

Accordingly, while a few embodiments of the present invention have been shown and described, it is to be understood that many changes and modifications may be made thereunto without departing from the spirit and scope of the invention as defined in the appended claims.

What is claimed is:

1. A spinning can transporter driven by an operator for transporting a series of spinning cans having roving, the transporter comprising:

a) a loading platform disposed in the transporter;

b) a plurality of can loading spaces disposed on said loading platform, for receiving the series of spinning cans;

c) a set of operator controls adjustably mounted on the transporter so that the operator controls are readily available to the operator disposed on said loading platform; and d) a standing place for the operator on said loading platform, wherein said loading platform has at least one can loading space disposed on either side of said standing place for the operator.

2. The spinning can transporter according to claim 1, wherein said plurality of can loading spaces comprise at least one can receiving space and at least one can delivery space wherein the operator's standing place is disposed between said at least one can receiving space and said at least one can delivery space.

3. The spinning can transporter according to claim 1, further comprising:

a bow coupled to said platform and extending in a longitudinal direction above said platform wherein said set of operator controls are coupled to said bow and migrate in said longitudinal direction of the transporter during loading and unloading.

4. The spinning can transporter according to claim 3, wherein said plurality of can loading spaces comprise at least one can receiving space and at least one can delivery space wherein the operator's standing place is disposed between said at least one can receiving space and said at least one can delivery space as viewed in said longitudinal direction of the transporter.

5. The spinning can transporter according to claim 3, wherein the operator's standing place comprises a set of two joined can loading spaces for rectangular cans.

6. The spinning can transporter according to claim 3, wherein there is an empty can loading space adjacent to the operator's standing place at a start of an exchange of cans on a machine processing the roving.

7. The spinning can transporter according to claim 3, wherein said controls are displaceably supported in said longitudinal direction of the transporter.

8. The spinning can transporter according to claim 7, further comprising a guide disposed on the transporter above the operator said guide for displaceably supporting said controls, and wherein said controls have handles located at an operator's gripping level.

9. The spinning can transporter according to claim 1, wherein the operator's standing place includes a set of controls that are installed fixed between a set of two partial loading areas an said loading platform.

10. The spinning can transporter according to claim 9, wherein said two partial loading areas comprise a front loading area and a rear loading area, wherein both loading areas are substantially equal in size.

11. The spinning can transporter according to claim 9, wherein said set of operator's controls are arranged on said transporter so that there is a maximum spacing between the operator's standing place and said can loading space.

12. The spinning can transporter according to claim 9, wherein each of said set of two partial loading areas has a space for up to four can spaces successively arranged in said longitudinal direction of the transporter, wherein each of said two partial loading areas are designed to receive a set of rectangular cans standing flat against each other.

13. The spinning can transporter according to claim 9, wherein at least one of said set of two partial loading areas further comprises a revolving table with at least two can loading spaces that contains an area for receiving a set of round cans.

14. The spinning can transporter according to claim 13, wherein said revolving table is a manually actuatable table.

15. The spinning can transporter according to claim 13, wherein said revolving table has a sufficient surface area to receive up to four rectangular cans standing flatly against each other in the transport direction.

16. The spinning can transporter according to claim 9, wherein at least one partial loading area is a rectangular can loading area for receiving a set of rectangular cans, and a remaining partial loading area further comprises a revolving table for receiving a set of round cans.

17. The spinning can transporter according to claim 1, wherein said can loading spaces have sliding surfaces, roller tracks, conveyor belts, or chain conveyors for facilitating the pushing of said cans onto and off of the transporter.

18. The spinning can transporter according to claim 1, wherein on a longitudinal edge of the transporter, each can loading space has a transfer roller to push said cans onto and off of the transporter.

* * * * *